United States Patent [19]

Braddick

[11] Patent Number: 4,537,251

[45] Date of Patent: Aug. 27, 1985

[54] ARRANGEMENT TO PREVENT PREMATURE EXPANSION OF EXPANDABLE SEAL MEANS

[76] Inventor: Britt O. Braddick, P.O. Box 35729, Houston, Tex. 77235

[21] Appl. No.: 597,697

[22] Filed: Apr. 6, 1984

[51] Int. Cl.[3] ..... E21B 23/06

[52] U.S. Cl. ..... 166/196; 166/118; 166/134

[58] Field of Search ..... 166/196, 195, 118, 217, 166/132, 134, 138, 381, 382, 387

[56] References Cited

U.S. PATENT DOCUMENTS

| | | | |
|---|---|---|---|
| 3,631,927 | 1/1972 | Young | 166/134 |
| 3,749,166 | 7/1973 | Young | 166/134 X |
| 4,106,565 | 8/1978 | Braddick | 166/118 |

*Primary Examiner*—Stephen J. Novosad
*Assistant Examiner*—Thuy M. Bui
*Attorney, Agent, or Firm*—Jack W. Hayden

[57] ABSTRACT

A tubular member is provided with expandable seals which are expanded into sealing engagement with a surrounding surface by a sleeve actuating member on the tubular member. A releasable retaining member is secured to the tubular member and has shoulder means adjacent one end interlocked with shoulder means adjacent an end of the sleeve actuating member to retain the sleeve actuating member in nonexpanding seal position as the tubular member is lowered into position in the well bore. The shoulder means on the releasable retaining member is on a longitudinally extending, radially flexible portion of the retaining member. An annular shoulder intermediate the ends of the flexible portion engages the upper end of a liner in the well bore, and moves the flexible portion radially inwardly to disengage the interlocked shoulder means, thus releasing the sleeve actuating means to expand the expandable seals.

10 Claims, 2 Drawing Figures

ARRANGEMENT TO PREVENT PREMATURE EXPANSION OF EXPANDABLE SEAL MEANS

BACKGROUND OF THE INVENTION

1. Field of the Invention

This invention relates to an arrangement for preventing premature actuation of expandable seal means as a device is lowered into a well bore and for assuring actuation when it is desired to expand the seal means.

2. Description of the Prior Art

Where a liner is positioned in a well casing as an extension thereof, it may be desirable under some circumstances to thereafter position a seal in the well bore which engages with the portion of the casing or well string above the liner.

Various devices have been proposed and are in use for positioning an expandable seal means in a well string above a liner receptacle, and various means and arrangements have been suggested and are employed in an endeavor to maintain the actuating means which expands the packers in a position so that the packers will not be prematurely expanded before reaching the desired elevation in the well bore or before positioning the packers above the annular upper end of a liner in a well string.

The prior art with which Applicant is most familiar is U.S. Pat. No. 4,106,565 issued on Aug. 15, 1978; U.S. Pat. No. 1,804,818; U.S. Pat. No. 2,753,941; U.S. Pat. No. 2,791,278.

While the arrangement illustrated in U.S. Pat. No. 4,106,565 works quite satisfactorily, it has been determined that under some circumstances there may be premature activation of the retaining means disclosed therein so that the expandable seal actuating means is released which would cause premature expansion of the seal means. Also, if the liner, or receptacle, in which the arrangement is to be employed becomes damaged, this may interfere with, or even prevent, the proper activation of the retaining means to release it.

The present invention provides an arrangement in which the retaining means which engages and holds the expandable seal activating means is constructed so that it cannot be activated unless it is contracted substantially throughout its circumferential extent, thus greatly reducing if not substantially eliminating the probability of premature release by engaging the projecting ledges or shoulders of tubular members which are exposed internally of the well string through which the device is lowered. Even though a portion of the retaining means of the present invention should come in contact with an annular segment of a projection such as the end of a tubular member, or any other projection that might be in the well string, this will not release the retaining mechanism of the present invention. In prior art devices which rely upon a shear mechanism such as shear pins and the like to secure the actuating means against premature release, contact with a shoulder or projection in the well string as the device is lowered therethrough might shear the mechanism and release the actuating means. In the present invention, it will not release the actuating means prematurely even though the actuating means should bump against a shoulder as the device is lowered in the well string with a substantial jar.

Thus, the present arrangement requires that the retaining arrangement be engaged and contracted throughout substantially its circumferential extent, and this is effected when the device is seated in the upper end of the liner receptacle at the position where it is desired to release the actuating means so that the expandable seal means may be expanded into engagement with the well string immediately above the liner.

Further, the release of the actuating means for all practical purposes is accomplished merely by seating the device at the desired location in the well bore, namely, on the annular upper end of the liner receptacle and permitting the weight of the well string which has lowered the device in the well to rest thereon which causes the releasable retaining means to engage the liner upper end throughout substantially its circumferential extent. This contracts or collapses a flexible portion of the releasable retaining means to disengage the retaining means from the actuating sleeve means so that the expandable packer means may be expanded into engagement with the surrounding well string above the liner receptacle.

DESCRIPTION OF PREFERRED EMBODIMENT

Figure 1:
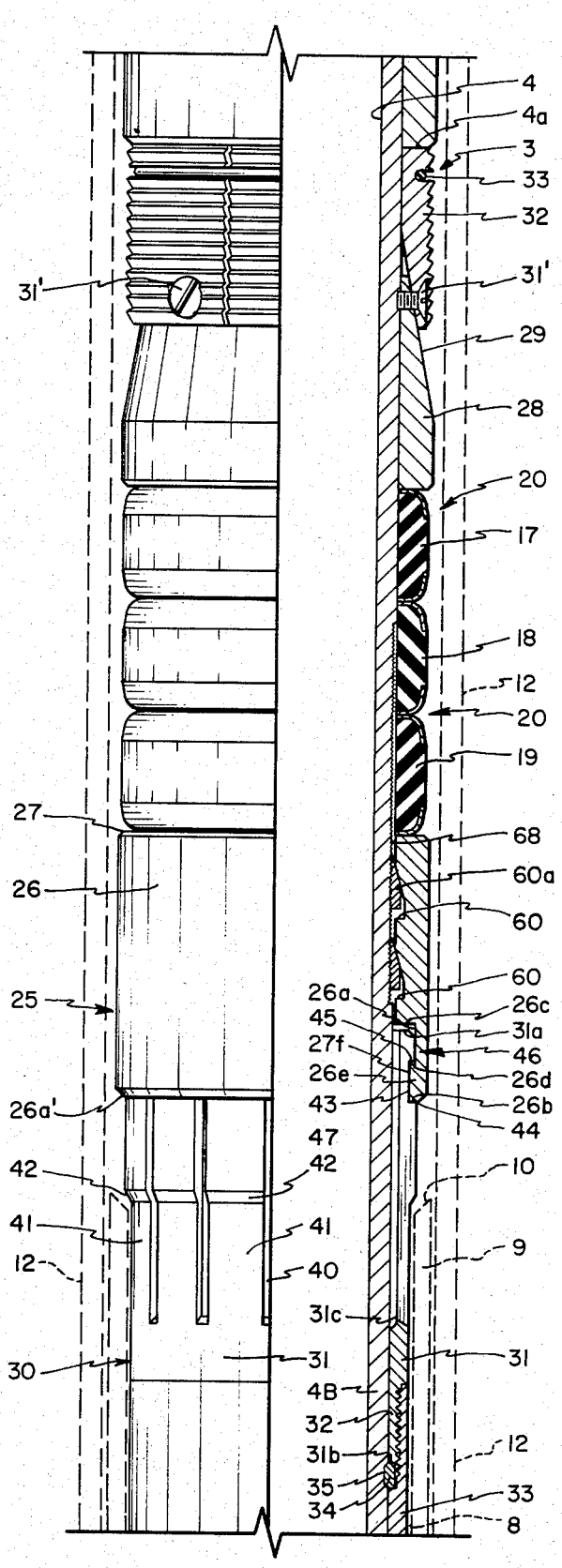
FIG. 1 is a one-quarter sectional view of the device of the present invention.

The present invention is illustrated at 3 in FIG. 1 and is supported on a tubular member 4 of desired longitudinal extent. A liner 9 is positioned in a well string, represented by the dotted line 12, by means well known in the art and forms an extension of the well string. In those instances where it is desired to seal off between the liner 9 and well string 12 of which the liner is a part, or extension, the invention 3 is employed for sealably engaging above the liner 9 with the well string 12, and chevron packing is provided on a lower extension (not shown) of the invention 3 to seal off between the inner surface 8 of liner 9 and lower portion 4B of the tubular member telescopically received therein.

Actuating means referred to generally at 25 are provided for expanding the expandable seal or packer means 20 into engagement with the well string 12 above the upper end 10 of the liner 9. Releasable retaining means 30 are engaged with the actuating means 25 and the tubular member 4 to retain the actuating means in a nonactuatable position until the releasable retaining means 30 engages substantially the full annular end 10 of liner 9.

The actuating means 25 includes a setting sleeve 26 surrounding member 4 as shown with the upper end 27 thereof abutting one end of the expandable packer or seal means 20. Expandable packer means 20 may be formed in any suitable manner, and as shown, comprises three solid annular elastomer members 17, 18 and 19 mounted on the outer circumference of the tubular member 4 between the upper end 27 of the setting sleeve 26 and the conical collar 28.

Figure 2:
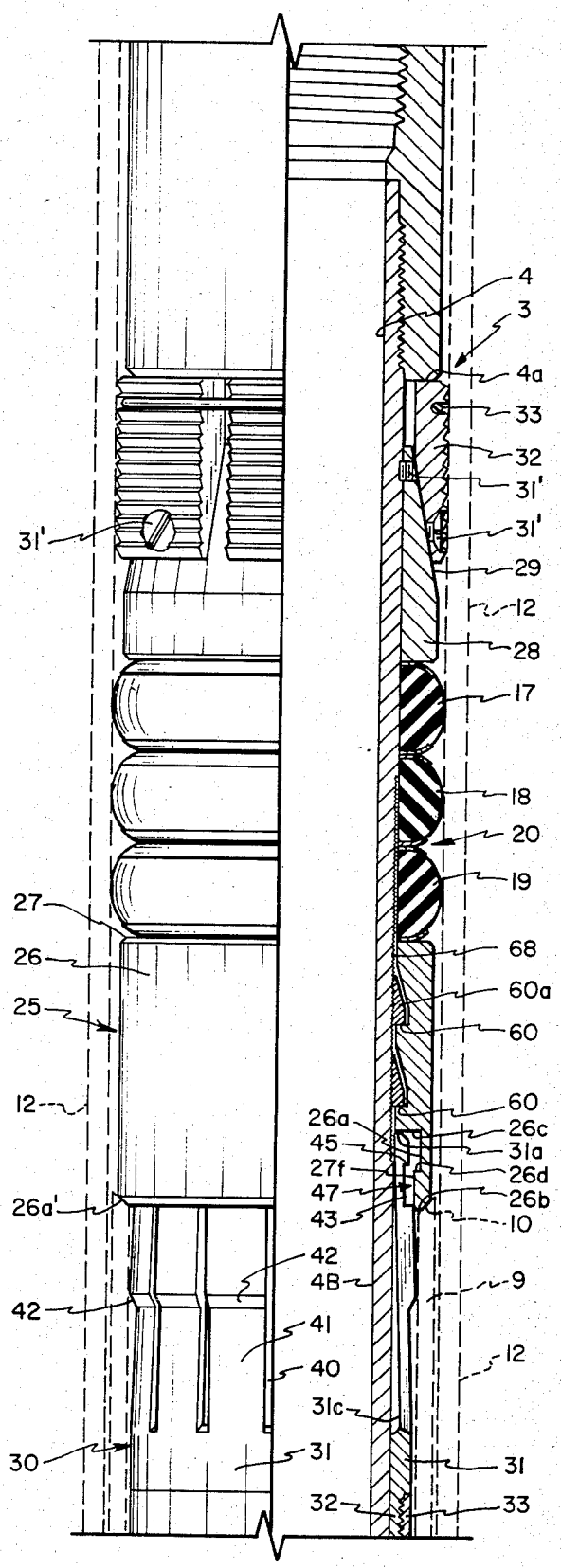
FIG. 2 is a one-quarter sectional view similar to FIG. 1 and illustrating the relative position of the components after the releasable retaining means has been engaged with the annular upper end of the liner receptacle to accommodate longitudinal movement of the sleeve actuating means for expansion of the expandable seal means.

Collar 28 includes an annular tapered surface 29, and collar 28 is secured by shear pin means 31' to annular slip segments 32 resiliently retained in position on the tubular member 4 by the spring 33. Slip segments 32 abut shoulder 4A of tubular member 4 as illustrated in the drawings and are retained in position thereagainst for actuation of the device as illustrated in FIG. 2 and will be described in greater detail.

The releasable retaining means 30 includes the collar 31 threaded at its lower end 32 to the lower extension 33 which carries the chevron packing. A lock ring 34 in groove 35 in tubular member 4 secures or positions the releasable retaining means and more particularly the collar 31 thereof so as to prevent relative longitudinal movement between the collar 31 and the tubular member 4. Longitudinally extending slots 40 circumferentially spaced in the collar 31 extend from the slotted end 31*a* of the collar 31 as shown and terminate in spaced relation to the other end 31*b* of the collar 31. Counterbore 31*c* is provided on the inner surface of the collar 31 and is adjacent the slots 40 to define a portion of the collar 31 which is thinner than the remainder so that longitudinal flexible members 41 are formed on the collar 31. The counterbore 31*c* forms the inner surface of members or fingers 41 and is radially spaced from the outer surface of tubular member 4 which provides an annular space to enable members 41 to be moved or collapsed radially inwardly. Intermediate the ends of the flexible members 41 is an upwardly tapered annular extending shoulder 42 formed on the outer surface of collar 31 and hence on each of the members 41 as shown.

Spaced from the slotted end 31*a* of collar 31 is an annular, outwardly facing groove 43 providing spaced annular external facing shoulders 44 and 45 as shown. The end portion of the flexible members 41 from the shoulder 45 to the end 31*a* of collar 31 provides an outwardly projecting annular shoulder means referred to generally at 46 which is received in the groove 26*a* when the actuating means 25 and the releasable retaining means 30 are telescopically coupled as shown in FIG. 1.

The sleeve 26 of the seal actuating means 25 includes an inwardly facing groove 26*a* adjacent but spaced from the sleeve end 26*b* which is nearest the releasable retaining means 30. The annular groove 26*a* thus provides spaced annular internal facing shoulders 26*c*, 26*d* forming therebetween an annular groove which faces inwardly. The portion 26*e* of sleeve 26 between shoulder 26*d* and sleeve end 26*b* is provided with an annular surface 27*f* which is greater in diameter than the internal diameter of the sleeve 26 immediately adjacent the inner termination of shoulder 26*c*. The annular surface 27*f* thus forms inwardly projecting shoulder means on the sleeve actuating means 26 referred to generally by the numeral 47.

By collapsing the flexible members 41 inwardly, the shoulder means 46 on releasable retaining means 30 may be telescoped into actuating means 25 and positioned in annular, inwardly facing groove 26*a* which also positions internal shoulder means 47 within external facing groove 43 on releasable retaining means 30.

When the actuating means 25 and the releasable retaining means 30 are thus telescopically coupled together by their respective shoulder means as shown in FIG. 1, the sleeve 26 is locked against longitudinal movement along tubular member 4 until the interlocking shoulders 46, 47 are released.

Thus, as the present invention is lowered into the well bore, it can be appreciated that there will not be premature release merely because a portion of the shoulder 42 is engaged by or banged against a ledge of any type within the well string as it is lowered into the well bore. In other words, in order to effect release of the actuating means 25 from the retaining means 30, the flexible members 41 must all be collapsed inwardly substantially simultaneously so as to effect disengagement of the shoulder means 46 from the groove 26*a* and disengagement of the shoulder means 47 from the external groove 43 on the releasable retaining means.

As a practical matter, substantially the only way that this can be effectively accomplished is by engaging the external shoulder 42 on each of the flexible members 41 with the upper tapered surface 10 of the liner 9 and resting the well string thereon sufficiently so as to cause the flexible members 41 to move radially inwardly and enable the shoulder means 46 to disengage from the internal groove 26*a*′ and to enable the shoulder means 47 to disengage from the external groove means 43.

After the releasable retaining means 30 is unlocked from the actuating means 25, continued lowering of the well string telescopes the flexible members 41 into the liner 9 so that the upper end 10 thereof engages the annular tapered surface 26*a*′ on the lower end of sleeve 26 and effect movement thereof upwardly. Upward movement of the setting sleeve 26 shears the pin 31′ and moves the conical member 28 so as to expand the slip segments 32 into seating engagement with the well string 12 as shown in FIG. 2 of the drawings. Further, movement of the seal means on tubular member 4 is continued until they have sealingly engaged with the well string 12 and during such longitudinally upward travel of the setting sleeve 26, the slip segments 60*a* carried in grooves 60 within the sleeve 26 travel upwardly along with the sleeve 26 and along the serrated surface 68 formed on the outer portion of the tubular member 4. When movement of the setting sleeve 26 stops due to sealing engagement of the packers 17, 18 and 19 with the well string 12 as shown in FIG. 2, the segments engage the serrated surface 68 and lock the setting sleeve 26 in position to maintain the seals expanded.

Since the entire circumference of collar 31 must be contracted to affect release between means 25 and 30, premature release by engaging or striking a projection as the device is lowered in the well bore is prevented. Also, if the inner surface of liner 9 is damaged adjacent its upper end 10, the fingers 41 are sufficiently long to span such damage and still collapse when they engage the normal inside diameter of the liner to effect release between means 25 and 30.

The foregoing disclosure and description of the invention are illustrative and explanatory thereof, and various changes in the size, shape and materials as well as in the details of the illustrated construction may be made without departing from the spirit of the invention.

What is claimed is:

1. In a seal nipple packer having a tubular member with seals thereon for sealing above the annular end of a tubular receptacle supported in a well string, the invention including:

expandable seal means on the tubular member for sealing with the well string above the annular end of the receptacle;

actuating means including a setting sleeve movable on the tubular member for expanding said expandable seal means into engagement with the well string; and releasable retaining means having a radially flexible portion engaged with said actuating means and the tubular member to retain said actuating means in a nonactivated position until said radially flexible portion of said releasable retaining means engages substantially the full annular end of the tubular receptacle and is radially collapsed to release said retaining means from said actuating means.

2. In a seal nipple packer having a tubular member with seals thereon for sealing above the annular end of a tubular receptacle supported in a well string, the invention including:

expandable seal means on the tubular member for sealing with the well string above the annular end of the receptacle;

actuating means including a setting sleeve movable on the tubular member for expanding said expandable seal means into engagement with the well string;

radially collapsible releasable retaining means engaged with the tubular member; and means engaging said actuating means and releasable retaining means to maintain said actuating means in a nonactivated position until said releasable retaining means is disengaged therefrom by engaging the annular end of the tubular receptacle to radially collapse and release said retaining means from the actuating means.

3. The invention of claims 1 or 2 wherein said releasable retaining means includes annular external facing shoulder means formed by external facing groove means, and wherein said actuating means includes annular internal facing shoulder means thereon formed by an internal facing groove means with said external facing shoulder means engaged in the internal facing groove means and with said internal facing shoulder means engaged in the external facing groove means.

4. The invention of claims 1 or 2 wherein said releasable retaining means includes a collar having slots extending longitudinally from one end and a counterbore in said collar adjacent the slots to form radially flexible longitudinal members;

said collar having an external facing annular groove adjacent but spaced from said slotted collar end which forms external facing shoulder means; and wherein said setting sleeve includes an annular internal facing groove adjacent but spaced from the sleeve end nearest said retaining means to form internal facing shoulder means on said setting sleeve interlocked with said external facing shoulder means on said collar to maintain said actuating means against premature release.

5. The invention of claim 4 including an annular upwardly tapered external shoulder intermediate the ends of the slots, said annular shoulder engageable with the annular end of the receptacle to collapse said flexible members inwardly and disengage said interlocked shoulder means for release of said actuating means to expand said seal means.

6. The invention of claims 1 or 2 wherein said releasable retaining means includes radially flexible members having circumferentially extending shoulder means on an end nearest said actuating means and wherein said actuating means includes internal circumferentially extending shoulder means adjacent an end nearest said releasable retaining means whereby said shoulder means on said retaining means and actuating means may be interlocked to prevent premature release of said sleeve actuating means.

7. The invention of claim 6 including an annular upwardly tapered external shoulder intermediate the ends of said radially flexible members engageable with the annular end of the receptacle to collapse said flexible members inwardly and disengage said interlocked shoulder means for release of said actuating means to expand said seal means.

8. The invention of claim 1 wherein said releasable retaining means includes annular external facing shoulder means formed by external facing groove means, and wherein said actuating means includes internal facing shoulder means thereon formed by an internal facing groove means with said external facing shoulder means engaged in the internal facing groove means and with said internal facing shoulder means engaged in the external facing groove means and including means to release said external and internal facing shoulder means from their respective groove means whereby said actuating means may move to expand said seal means.

9. The invention of claim 8 wherein said means to release includes an annular shoulder on said releasable retaining means engageable with the annular receptacle end to move said retaining means radially to disengage said external facing shoulder means from the internal facing groove means on said actuating means, and to disengage said internal facing shoulder means from the external facing groove means on said retaining means.

10. The invention of claim 2 wherein said releasable retaining means includes annular external facing shoulder means formed by external facing groove means, and wherein said actuating means includes internal facing shoulder means thereon formed by an internal facing groove means with said external facing shoulder means engaged in the internal facing groove means and with said internal facing shoulder means engaged in the external facing groove means and including means to release said external and internal facing shoulder means from their respective groove means whereby said actuating means may move to expand said seal means.

* * * * *